US005280713A

United States Patent [19]

Hansen et al.

[11] Patent Number: 5,280,713

[45] Date of Patent: Jan. 25, 1994

[54] YARN FEED DEVICE FOR KNITTING MACHINE HAVING SEPARATOR MEANS FOR HOSIERY FABRIC

[75] Inventors: Leroy M. Hansen, Clemson; Bruce Kritz, Salem, both of S.C.

[73] Assignee: The Kendall Company, Mansfield, Mass.

[21] Appl. No.: 999,433

[22] Filed: Dec. 29, 1992

[51] Int. Cl.[5] ..... D04B 15/44; D04B 35/00; B65H 51/08; B07C 9/00

[52] U.S. Cl. ..... 66/146; 66/8; 66/147; 66/149 S; 242/47.08; 220/260; 220/263; 209/657

[58] Field of Search ..... 66/125 R, 146, 147, 66/149 R, 149 S; 242/47.01, 47.02, 47.04, 47.08, 47.09; 220/260, 263; 226/36, 45; 248/95, 97, 587; 209/657

[56] References Cited

U.S. PATENT DOCUMENTS

| | | | |
|---|---|---|---|
| 2,343,439 | 3/1944 | Allen et al. | 248/95 |
| 3,323,753 | 6/1967 | Spurgeon | 242/147 |
| 3,511,062 | 5/1970 | Nogues | 66/149 R |
| 3,858,416 | 1/1975 | White et al. | 66/146 X |
| 3,891,155 | 6/1975 | Naegeli | 242/47.01 X |
| 4,372,461 | 2/1983 | Lerman et al. | 220/260 |
| 4,669,625 | 6/1987 | Armstrong | 220/260 X |
| 4,706,476 | 11/1987 | Memminger et al. | 66/132 R |
| 4,752,044 | 6/1988 | Memminger et al. | 242/47.01 |
| 4,884,699 | 12/1989 | Maassen et al. | 209/587 |
| 5,035,372 | 7/1991 | Siebertz | 242/47.01 X |

*Primary Examiner*—Clifford D. Crowder
*Assistant Examiner*—John J. Calvert
*Attorney, Agent, or Firm*—Alvin Isaacs

[57] ABSTRACT

An apparatus which provides for servo regulation of a yarn furnisher for a circular knitting machine which permits the knitting machine to operate at a higher speed, controls and varies the tension of the yarn supplied to a knitting machine, and provides a two-bagging unit receptacle for the directing and receiving of the knitted products.

8 Claims, 4 Drawing Sheets

YARN FEED DEVICE FOR KNITTING MACHINE HAVING SEPARATOR MEANS FOR HOSIERY FABRIC

BACKGROUND OF THE INVENTION

This invention is directed towards improvements in the operational speed of circular knitting machines.

The speed and efficiency of the circular knitting process is often limited by external constraints unrelated to the actual knitting process. Among these limitations are the speed and tension in which yarn is supplied to the knitting machine, the ability of the knitting machine to be coordinated with the availability of raw materials, as well as the ability of a knitting machine to continue operation while the finished product is being removed.

Such limitations have heretofore limited the operation of circular knitting machines to relatively low speeds. Therefore, there is much room for improvement in the art of knitting machines.

SUMMARY OF THE INVENTION

It is thus an object of this invention to provide an improved yarn furnisher for a knitting machine which permits the knitting machine to operate at a higher speed.

It is a further object of this invention to provide a yarn furnisher for a knitting machine which can control the tension of the yarn supplied to a knitting machine.

It is still a further and more particular object of this invention to provide a yarn furnisher which enables better control of the relative amount of yarn supplied to a knitting machine.

It is still a further and more particular object of this invention to provide a dual bag unit for receiving knitted products from a knitting machine.

These and other objects of the invention are provided by a circular knitting machine having a yarn furnisher attachment for providing stretchable yarn at selected tension levels and at elevated speeds comprising a yarn furnisher for supplying yarn to a circular knitting machine comprising: a housing, the housing supporting a pair of rollers defining a cradle for supporting a spool of yarn, each member of the roller pair having a first roller end and a second roller end, the first roller end terminating in an end cap and the second roller end further defining a tension equalizing roller, each tension equalizing roller having a plurality of grooves; guide means for directing a filament of yarn from the spool to the tension equalizing rollers; a motor having engagement means for rotating the pair of rollers, the motor speed responsive to an input signal from a servo controller in further communication with the circular knitting machine, changes in the motor speed providing a tension controlling means for varying the tension of the yarn supplied to the circular knitting machine; a first detector in communication with the spool of yarn, the first detector comprising: a visible light force directed against the spool of yarn; a light meter for measuring the amount of the light source reflected off the yarn spool; an alarm, in communication with the circular knitting machine, the alarm activated in response to a pre-set level of the light received by the light meter, the alarm preventing the circular knitting machine from initiating a sequential article; a distance detector in communication with a core of the spool of yarn, the distance detector providing a means for monitoring the relative distance between the core of the spool and a roller, the distance detector in further communication with the first detector, the distance detector disarming the alarm of the first detector until the core is within a pre-set distance of the roller.

The invention further provides a dual bagging unit having a first side and a second side for directing articles into a first bag and a second bag comprising: a base having a first side and a second side; a pair of vertical uprights connected at a first end to the base, the uprights further connected by a horizontal cross brace; a diverter arm, the arm pivotally attached to the vertical upright in providing a first attachment site for the first bag and the second bag; biasing means for directing the diverter arm from a first side of the bagging unit to the second side of the bagging unit; a rim, attached to an upper region of the vertical upright, the rim providing a second attachment site for securing the first bag and the second bag; wherein the diverter arm is used to direct articles into a first bag, biasing means used to reposition the arm to an opposing side of the bagging unit, the arm closing the first bag while simultaneously diverting articles to the second bag in response to an external counter.

DETAILED DESCRIPTION

In accordance with this invention, it has been found that the speed of the circular knitting process can be efficiently increased by a series of improvements relating to apparatuses directed towards the supplying and monitoring of a yarn supply as well as an apparatus for receiving the finished knitted product. In particular, these improvements are especially useful in the knitting of tension control articles such as support stockings where the relative amount and tension of elastic yarn must be varied throughout the knitted article.

Figure 1:
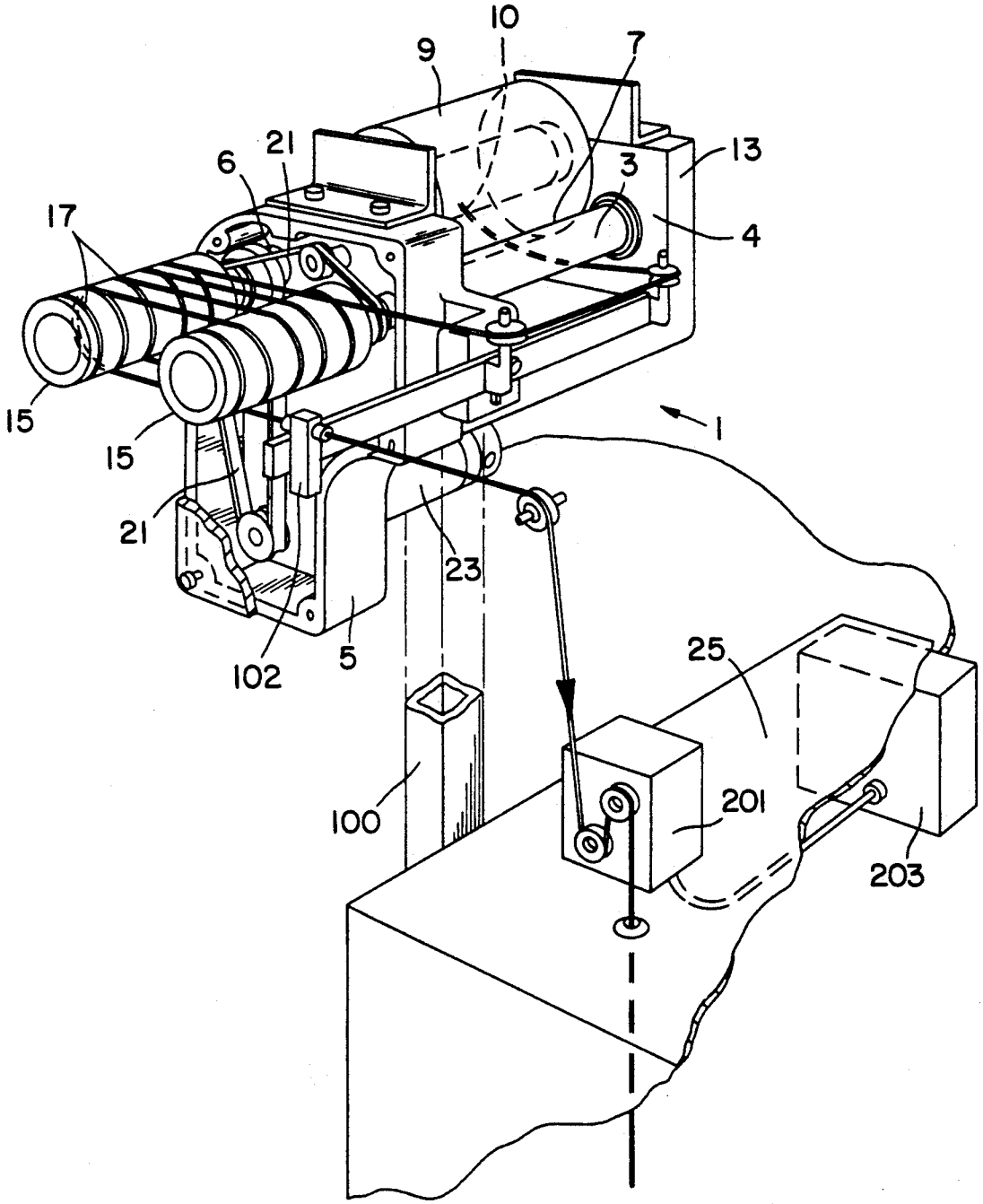
FIG. 1 of the drawings is a perspective view of the yarn furnisher apparatus of this invention.
Figure 2:
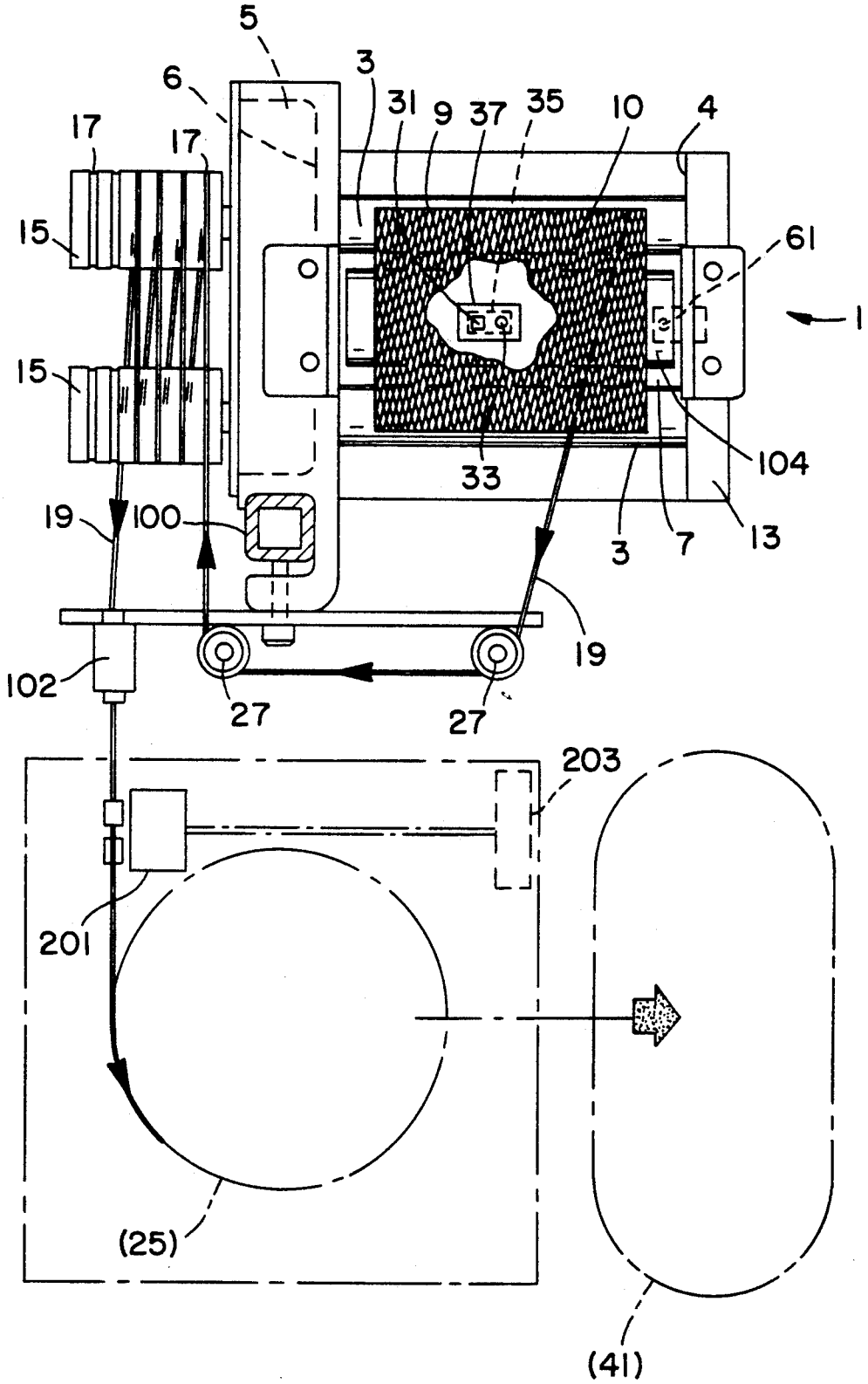
FIG. 2 of the drawings is a plan view of the furnisher apparatus of this invention.

As seen in reference to FIGS. 1 through 2, an improved yarn furnishing apparatus is provided having a pair of urethane covered rollers 3 extending from either side of a cast aluminum housing 5 which can be attached to an upright creel support 100 of a knitting machine. Self aligning, aircraft quality bearings support the rollers on either side of the housing.

The rollers 3 extend on a first side 4 of the housing and provide a cradle 7 for supporting a spool 9 wound with elastic textured yarn 10. Rollers 3 associated with cradle 7 are connected to a end piece 13 which provides additional stability to the rollers during high speed operation. Rollers 3 extend on the opposing second side 6 of housing 5 each roller providing a larger diameter tension equalizing roller 15, each equalizing roller having a plurality of grooves 17.

Rollers 3 further provide a means for engaging a drive belt 21. Drive belts 21 are driven by a separate yarn furnisher motor 23. The speed of the motor is itself regulated by a DC voltage input signal from the knitting machine 25 which controls the motor output. The input signal and output speed of the yarn furnisher are proportionately linear so that once a maximum speed is calibrated and adjusted, variations in the knitting machine speed are correspondingly made to the yarn furnisher motor.

As increased tension and compressive forces are desired in a given location in an elastic support stocking, the yarn furnisher speed relative to the circular knitting machine is decreased, thereby increasing the tension of the furnished yarn which is supplied to the circular knitting machine and subsequently incorporated into the knitted article. Similarly, where less tension or compressive force is needed within the support stocking, the speed of the yarn furnisher is increased.

It should be noted that at any single yarn tension setting, the speed of the yarn furnisher is coupled to the speed of the circular knitting machine. Thus, when the speed of the circular knitting machine is varied, the speed of the yarn furnisher will vary in a corresponding manner so as to maintain the given tension setting.

Further, a separate and independent regulation of the yarn furnisher speed is controlled by a servo-regulator 203 comprising part of the circular knitting machine. The servo-regulator, in conjunction with the circular knitting machine's software control of the knitting pattern, permits the selection of a desired tension level to be located within the stocking. Thus, even when the knitting machine speed is held constant, the yarn furnisher motor speed can be varied to change the tension of the yarn supplied to the circular knitting machine. In this manner, the tension of the yarn incorporated into the stocking is independently regulated according to the knitting location and desired tension setting within an individual stocking.

The servo-regulation of the tension of the furnished elastic yarn in relation to the knitting location within an article permits high quality reproducible results in the knitted product. Furthermore, the ability to accurately control and vary the tension within a knitted article permits the production of prescription stockings which are tailored to a patient's individual needs.

As best seen in FIG. 2, yarn furnisher 1 supports a tube of yarn 9 in cradle 7 defined by rollers 3. A strand of yarn 19 passes beneath a roller 3 and through a series of guides or pulleys 27, as it passes from the first side of the housing to the second side of the housing. The yarn then passes through the plurality of grooves 17 of the equalizing rollers. The equalizing rollers substantially eliminate variations in strand tension which initially result from the unspooling of the yarn. Therefore, the yarn 19 exits the equalizing roller 15 without any tension variations caused by the unspooling. From the equalizing rollers, the yarn passes through a thread detector 102 which will shut down the knitting machine if the thread should break.

It is thus seen that once the yarn exits the equalizing rollers, the tension as well as the amount of the yarn supplied to the circular knitting machine can be varied by the servo-regulation of the speed of the yarn furnisher relative to the speed of the knitting machine. Where greater tension is desired in a knitted article, such as a vascular support stocking, the speed of the yarn furnisher relative to the speed of the knitting machine is decreased. The resulting increased tension of the supplied yarn increases the tension and hence the vascular compression within the corresponding portion of the knitted stocking.

As the tension requirements vary over the length of a vascular compression stocking, the tension of the textured elastic yarn 19 supplied to the circular knitting machine is proportionately varied. The present invention can supply textured yarn at controlled tension levels at much greater sustained speeds than was heretofore available. Substantial benefits are achieved through higher production rates, improved quality control, and increased automation.

For added control, a tension monitor 201 can be placed between the yarn furnisher and the circular knitting machine. Tension monitor 201 measures the actual tension of the yarn as supplied to the circular knitting machine. By monitoring and relaying the actual tension value of the furnished yarn to the servo controller 203, the yarn furnisher speed can be adjusted to compensate for variables associated with minor differences in yarn quality, routine wear of the rollers, and any other upstream variables which may affect the actual tension of the furnished yarn. Therefore, by monitoring the yarn tensioner through monitor 201, servo regulator 203 can precisely regulate the yarn tension by adjustments to the yarn furnisher motor.

To further increase efficiency in automation of the knitting process, a cooperating pair of detectors is positioned to monitor the textured yarn supply. Positioned beneath cradle 7, a first run-out detector 31 employs a visible red light emitting diode 33 (LED) to illuminate a detection area 35 along the center of the spool of yarn. As the amount of yarn on the spool decreases, the darker colored spool becomes visible beneath the spooled yarn, and the amount of reflected light decreases. A light meter 37 of the run-out detector is used to measure the amount of reflected light. An amplifier boosts the voltage generated by the light meter. As the reflected light, measured by the boosted voltage reading, falls below a certain level, an alarm sounds which is communicated to the knitting machine. This alarm message prevents the knitting machine from initiating a new article when there is insufficient yarn to complete that article.

For greater accuracy and reliability, the visible light run-out detector can be used in conjunction with a distance detector 61 which monitors the distance of the spool core 104 from rollers 3 associated with cradle 7. Using infra-red light, sound waves, or other well known distance detecting means, the distance detector 61 measures the relative position of the spool core from the rollers 3. As the spool of yarn is unwound, the spool core 104 is lowered relative to the rollers. The distance detector 61 prevents the visible red light detector from becoming activated until a minimum amount of yarn has become unwound from the spool. This arrangement prevents a false alarm of the visible run-out detector caused by possible soiled yarn regions.

Following knitting of an article, the finished article is transported from the knitting machine and deposited in an automatic dual-bag unit 41. The dual-bag unit permits automatic bagging of a desired number of units per bag and permits the production of additional knitted products even after the initial bag has been filled.

Figure 3:
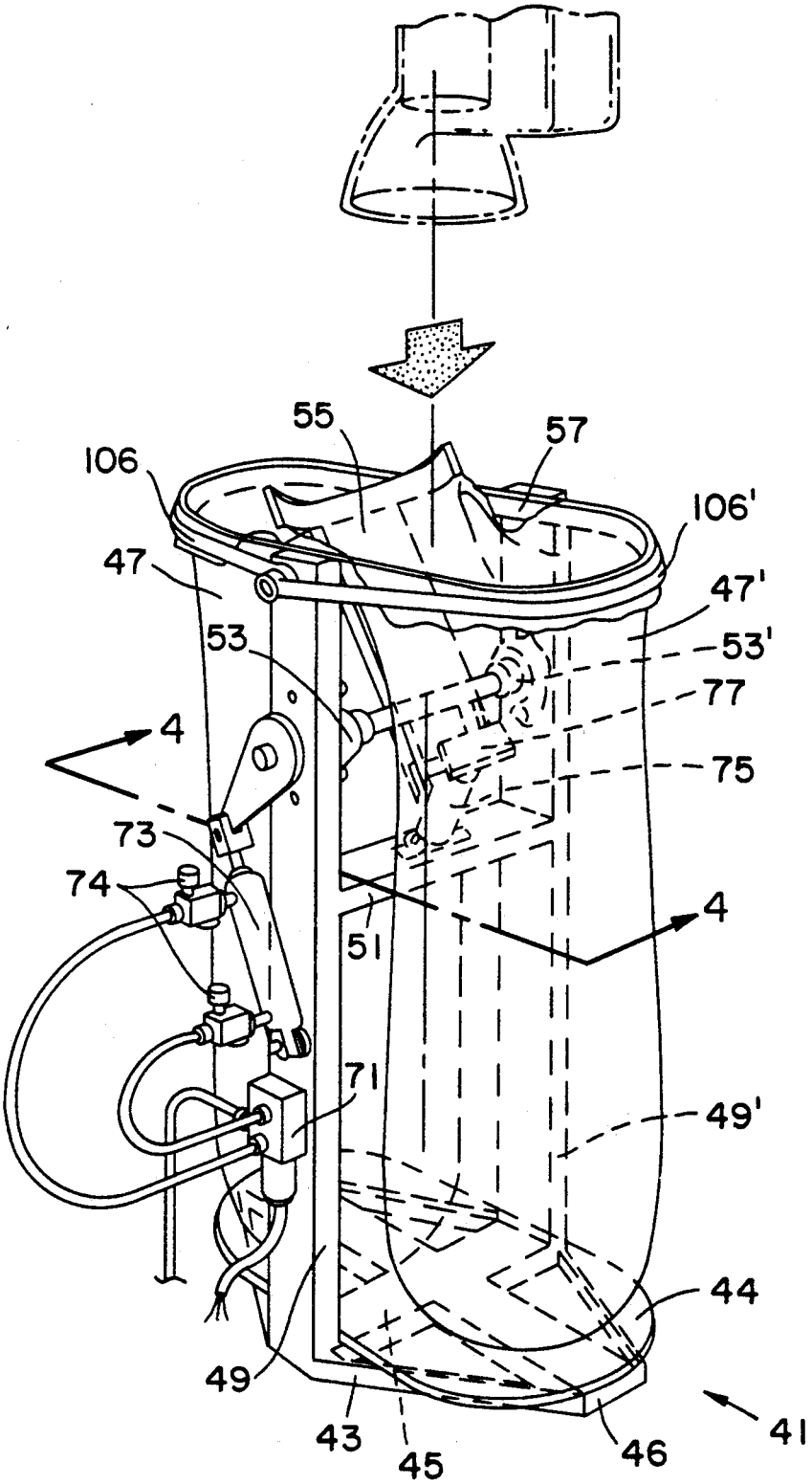
FIG. 3 of the drawings is a perspective view of the dual bagging apparatus of this invention.

As seen in reference to FIG. 3, the bagging unit has diamond shaped base 43 having integral cross braces 45 and 46 which connect opposite sides of base 43. The base 43 provides bottom support to a pair of bags 47 and 47'. Base cover 44 further protects the bags and knitted contents from contamination and possible soilage by debris or fluids such as oily residues which are commonly found on the work floor surface of circular knitting machines.

Two vertical uprights 49 and 49', connected by a horizontal cross brace 51, are connected to the base and provide a pair of pivot bearings 53 and 53'. Attached to pivot bearings 53 and 53' is an arcuate diverter arm 55 attached at each end to the respective pivot bearing. Diverter arm 55 can be pivoted into opposite positions along the upper portion of the bagging unit.

Attached to vertical uprights 49 and 49' is an oval shaped fixture 57 which roughly corresponds in area to the diameter of the base of the bagging unit. The fixture 57 provides an elastic attachment means 106 and 106' for attaching an upper portion of each bag to either side of the bagging unit 41. The unattached portion of either bag is secured to the overhead diverter arm 55. In this way, as the diverter arm moves from one side of the bagging unit to another, the diverter arm closes one bag while simultaneously opening the adjacent bag. Further, the diverter arm helps deflect the incoming knitted article into the appropriate bag. When a bag is either full or not yet in use, the closed position of the diverter arm keeps the interior of the bag free from contamination. Once filled, the bag can be removed without interfering with the ongoing knitting operation since the adjacent bag continues to receive the knitted product.

The diverter arm is activated by pneumatic means utilizing a solenoid 71 controlling a double acting pneumatic cylinder 73 with dual flow controls 74 and 74'. The diverter arm 55 is responsive to a counter in communication with the knitting machine so that the diverter closes one bag upon receiving the appropriate number of articles while simultaneously opening and directing additional products to the next adjacent bag.

Figure 4:
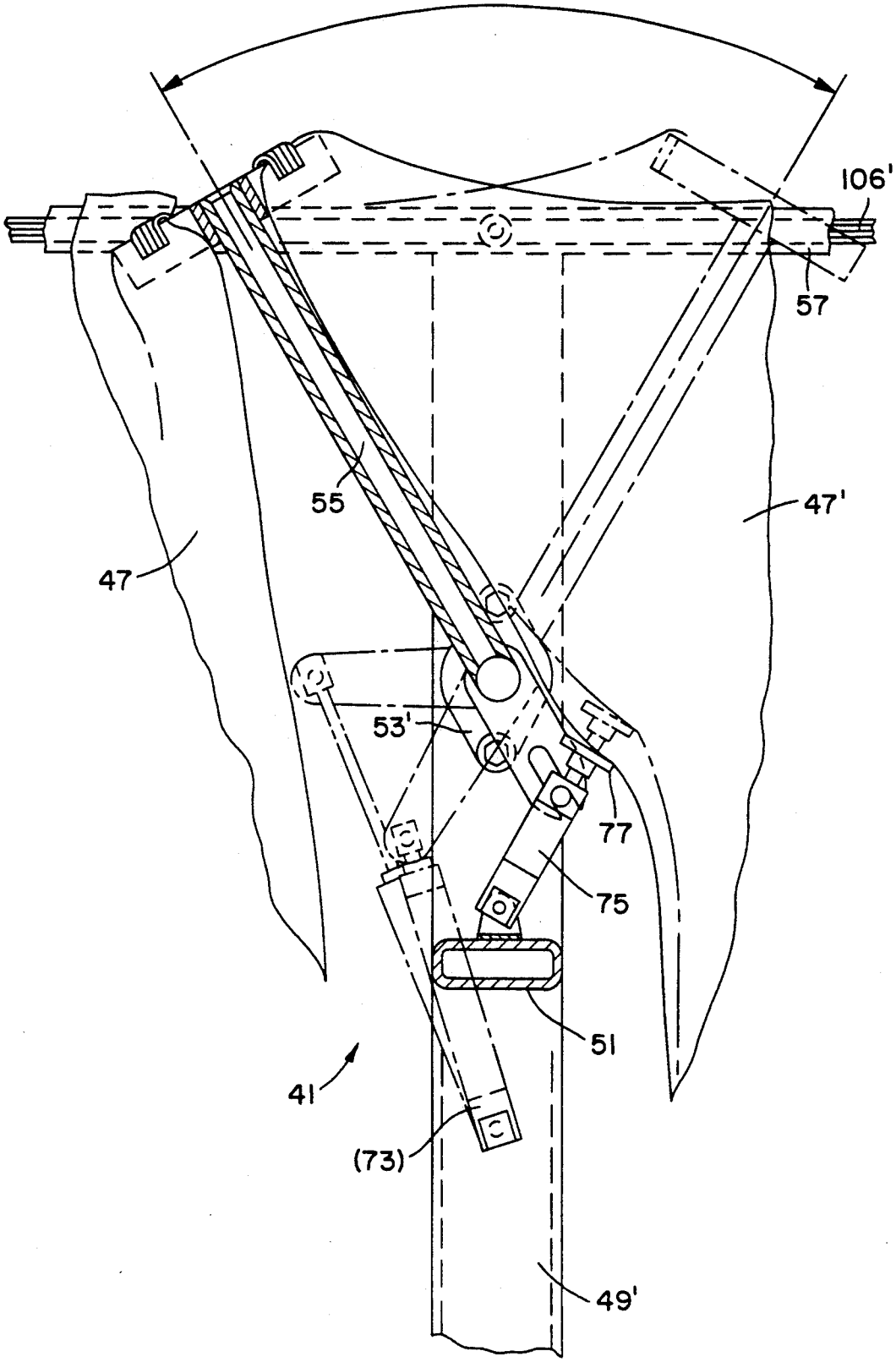
FIG. 4 of the drawings is a partial sectional elevation view of the dual bagging apparatus of this invention.

An additional embodiment for the dual-bag unit is seen in reference to FIG. 4 where an independently driven cylinder 75 is used to engage a reciprocator 77. Reciprocator 77 is used to periodically engage an upper portion of a filling bag. The engagement helps direct the deposited article toward the bottom of the filling bag. This feature is especially useful for bulky yet lightweight articles such as stockings which tend to collect around the upper bag region. The repeated engagement of the reciprocator helps direct the articles toward the bottom of the filling bag.

Ideally, reciprocator 77 operates at a slow speed to avoid any risk of injury to workers who monitor the bagging equipment. As seen in FIG. 4, the reciprocator 77 can be carried by arcuate diverter arm 55 such that as the arcuate arm moves, the reciprocator 77 is automatically placed in proper position relative to the bag which is to be filled.

Cylinder 75 can be provided with either a spring return system or may employ a double acting pneumatic cylinder with dual flow control similar to that described in reference to cylinder 73. It is necessary that reciprocator 77 remain in a retracted position whenever diverter arm 55 is in motion. Accordingly, a switching mechanism can be provided which will inactivate reciprocator 77 when a signal is directed to solenoid 71 or biasing diverter arm 55. This arrangement ensures that reciprocator 77 will not interfere with the movement of diverter arm 55.

The improvements of the present invention are directed to the supplying of materials to a knitting machine and the subsequent removal of the knitted products. The improvements vastly improve the speed and efficiency of the knitting process. A knitting machine having the present improvement directed towards the furnishing, monitoring and bagging means increases the production rate, decreases the amount of waste in machine down time, and permits an individual worker to monitor and operate a larger number of knitting machines with increased efficiency. The present invention requires no additional floor space, ensures proper tension on the supplied yarn, reduces product contamination, and requires no specialized skill or training to operate.

The above description is given in reference to an elastic yarn being supplied to a circular knitting machine for the manufacture of vascular compression devices such as hosiery. However, it is understood that many variations are apparent to one of skill in the art from a reading of the above specification and such variations are within the spirit and scope of the instant invention as defined by the following appended claims.

That which is claimed:

1. An apparatus for producing vascular tension articles comprising:

a circular knitting machine;

a yarn furnisher for supplying a thread of yarn to said circular knitting machine, said furnisher comprising a housing, said housing carrying a pair of rollers defining a cradle for supporting a spool of yarn, each member of said roller pair having a first roller end and a second roller end, each of said first roller ends terminating in an end cap and each of said second roller ends further defining a tension equalizing roller, each tension equalizing roller having a plurality of grooves;

guide means for directing said thread of yarn from said spool to said tension equalizing rollers;

a servo controller in communication with said circular knitting machine, a motor having engagement means for rotating said pair of rollers, speed of said motor responsive to an input signal from said servo controller, changes in the motor speed providing a tension controlling means for varying tension of said yarn supplied to said circular knitting machine.

2. The apparatus according to claim 1 further comprising:

a first detector in communication with said spool of yarn, said first detector comprising:

a visible light force directed against said spool of yarn;

a light meter for measuring the amount of said light source reflected off said yarn spool;

an alarm, in communication with said circular knitting machine, said alarm activated in response to a pre-set level of said light received by said light meter, said alarm preventing said circular knitting machine from initiating a sequential article;

3. The apparatus according to claim 2 further comprising:

a distance detector in communication with a core of said spool of yarn, said distance detector providing a means for monitoring the relative distance between the core of said spool and a roller, said distance detector in further communication with said first detector, said distance detector disarming said alarm of said first detector until said core is within a pre-set distance of said roller.

4. An apparatus for producing and collecting vascular tension articles comprising:

a circular knitting machine;

a dual bagging unit for receiving knitted articles from said circular knitting machine, said dual bagging unit directing said knitted articles into a first bag of a first side and a second bag of a second side, said unit further comprising;

a base;

a pair of vertical uprights connected at a first end to said base, said uprights further connected by a horizontal cross brace;

a diverter arm, said diverter arm pivotally attached to said vertical upright and providing a first attachment site for said first bag and said second bag;

biasing means for directing said diverter arm from a first side of said bagging unit to said second side of said bagging unit;

a rim, attached to an upper region of said vertical upright, said rim providing a second attachment site for securing said first bag and said second bag;

wherein said diverter arm is used to direct articles from said circular knitting machine into a first bag, biasing means used to reposition said arm to an opposing side of said bagging unit, said arm closing said first bag while simultaneously diverting articles to said second bag in response to an external counter.

5. The apparatus of claim 4 further comprising:

a reciprocator for periodically engaging an upper portion of said first bag and said second bag as said bags receive said knitted articles.

6. An apparatus for producing vascular tension articles comprising:

circular knitting machine;

a yarn furnisher for supplying a thread of yarn to said circular knitting machine, said furnisher comprising a housing, said housing carrying a pair of rollers defining a cradle for supporting a spool of yarn, each member of said roller pair having a first roller end and a second roller end, said first roller end terminating in an end cap and said second roller end further defining a tension equalizing roller, each tension equalizing roller having a plurality of grooves;

guide means for directing said thread of yarn from said spool to said tension equalizing rollers;

a servo controller in communication with said circular knitting machine;

a motor having engagement means for rotating said pair of rollers, speed of said motor responsive to an input signal from said servo controller, changes in the motor speed providing a tension controlling means for varying tension of said yarn supplied to said circular knitting machine;

a dual bagging unit for receiving knitted articles from said circular knitting machine, said dual bagging unit directing said knitted articles into a first bag of a first side and a second bag of a second side, said unit further comprising;

a base;

a pair of vertical uprights connected at a first end to said base, said uprights further connected by a horizontal cross brace;

a diverter arm, said arm pivotally attached to said vertical upright and providing a first attachment site for said first bag and said second bag;

biasing means for directing said diverter arm from a first side of said bagging unit to said second side of said bagging unit;

a rim, attached to an upper region of said vertical upright, said rim providing a second attachment site for securing said first bag and said second bag;

wherein said diverter arm is used to direct articles from said circular knitting machine into a first bag, biasing means used to reposition said arm to an opposing side of said bagging unit, said arm closing said first bag while simultaneously diverting articles to said second bag in response to an external counter.

7. A process for varying the tension of elastic yarn provided to a circular knitting machine comprising the following steps:

providing a supply of elastic yarn;

supporting said yarn on a pair of rollers of a drive assembly, providing a first end and second end on said pair of rollers, providing tension equalizing grooves on said second end of said pair of rollers, providing said drive assembly with a motor, said motor responsive to a first signal from a circular knitting machine, said motor further responsive to a second signal from a servo control unit, said servo. control unit in further communication with said circular knitting machine;

engaging said drive assembly;

removing a thread from said yarn supply;

feeding said yarn from said first end to said second end;

equalizing the tension of said thread;

furnishing said thread to said circular knitting machine;

varying the furnishing speed of said thread supplied to said circular knitting machine in response to said first signal;

adjusting the tension of said furnished yarn in response to said second signal, said tension adjusted by a change to said motor speed.

8. The process according to claim 7 including:

monitoring the tension of said furnished yarn, said monitoring means in communication with said servo control unit.

* * * * *